United States Patent [19]

Ballreich et al.

[11] Patent Number: 4,546,704

[45] Date of Patent: Oct. 15, 1985

[54] TRAINING CARTRIDGE WITH PLASTIC PROJECTILE OR DUMMY PROJECTILE

[75] Inventors: Kurt Ballreich, Nuremberg; Ernst Jensen; Jürgen Knappworst, both of Fürth , all of Fed. Rep. of Germany

[73] Assignee: Dynamit Nobel Aktiengesellschaft, Troisdorf, Fed. Rep. of Germany

[21] Appl. No.: 542,441

[22] Filed: Oct. 17, 1983

[30] Foreign Application Priority Data

Oct. 15, 1982 [DE] Fed. Rep. of Germany ..... 3238269

[51] Int. Cl.[4] ..... F42B 5/22

[52] U.S. Cl. ..... 102/444; 102/501; 102/529

[58] Field of Search ..... 102/430, 444, 464–470, 102/498, 501, 529, 445–463

[56] References Cited

U.S. PATENT DOCUMENTS

| | | | |
|---|---|---|---|
| 3,034,433 | 5/1962 | Gronn | 102/464 |
| 3,732,826 | 5/1973 | Johnson | 102/529 X |
| 4,142,466 | 3/1979 | Ballreich et al. | 102/513 |

FOREIGN PATENT DOCUMENTS

| | | | |
|---|---|---|---|
| 82834 | 3/1964 | France | 102/466 |
| 1372732 | 8/1964 | France | 466/ |
| 1442940 | 5/1966 | France | 102/444 |

*Primary Examiner*—Harold J. Tudor

*Attorney, Agent, or Firm*—Antonelli, Terry & Wands

[57] ABSTRACT

A training cartridge has a plastic projectile or plastic dummy projectile wherein the projectile or dummy projectile is integrally molded on a synthetic resin sleeve open at the rear end. The sleeve is inserted in a cartridge case of metal open at its front end. The cartridge case with case shoulder and case neck formed thereon is made to be open also at the rear end so that the synthetic resin sleeve can be inserted from the rear end into the cartridge case in close contact with the inner wall thereof. A separate metallic bottom piece is inserted into the rear end of the cartridge case, sealing the case tightly toward the rear.

7 Claims, 1 Drawing Figure

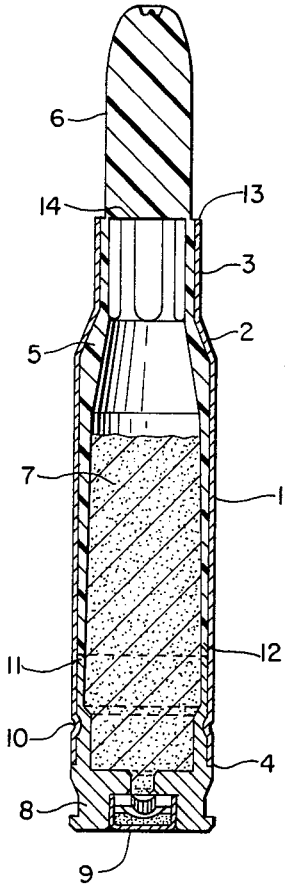
6
14
13
3
2
5
7
1
11
12
10
4
8
9

TRAINING CARTRIDGE WITH PLASTIC PROJECTILE OR DUMMY PROJECTILE

The invention relates to a training cartridge having a synthetic resin projectile or dummy projectile integrally formed on a synthetic resin sleeve or tube that is open at a rear or bottom end and that is inserted into the bottom open end of a metal cartridge case.

Training cartridges with a synthetic resin projectile are known with various designs. A cartridge has become widely popular which includes a bottom piece of metal and a tubular cartridge body with an integrally formed synthetic resin projectile. During firing, the projectile tears off at the mouth of the tube and is driven by itself through the barrel of the firearm. Furthermore, training cartridges are conventional wherein a synthetic resin projectile is placed on a cartridge case made of metal, or is inserted therein. Both arrangements exhibit advantages and drawbacks. In the former case, the relatively low durability of the synthetic resin sleeve and, in the latter case, the insecure seating of the plastic projectile in the metallic tube are features which, under certain circumstances, do not fully satisfy the requirements posed in an individual situation and which can cause feeding problems in the firearm and/or reduced firing accuracy.

Furthermore, a training cartridge is known wherein a synthetic resin sleeve is inserted from the front end in a metallic cartridge case open at the front end and sealed at the rear end. The synthetic resin sleeve, in turn, is open at its rear end and provided at its front end with a hollow dummy projectile which bursts at the tip during firing. The synthetic resin sleeve is uniformly in contact with the inner wall of the cartridge case and is held therein by flanging the front edge of the cartridge case against an annular bead of the synthetic resin sleeve to form a case shoulder. It has been found, however, that this arrangement can result under unfavorable circumstances during firing in irregularly torn off pieces in the region of the dummy projectile, or also in a "shooting" of the synthetic resin sleeve out of the metallic cartridge. Corresponding disadvantages were found when a synthetic resin projectile to be separated is provided in place of the dummy projectile.

This invention is based on the object of fashioning a training cartridge of the type having a synthetic resin projectile or dummy projectile integrally formed with a hollow sleeve or tubular member that is inserted from the bottom open end of a metal cartridge case and is retained within the case by a preformed neck and shoulder portions of the front end of the case as well as by a separate metallic closure member or bottom element positioned at the rear or bottom of the case. This arrangement provides a maximally simple manufacture and ensures that especially the function of the firearm and optionally also the firing accuracy of the projectile are improved.

Moreover, this arrangement ensures, on the one hand, due to the metallic case and its preformed neck portion, the required durability of the training cartridge and perfect seating of the plastic projectile or plastic dummy projectile in the metallic case and, on the other hand, permits a simple manufacture since the metallic case, including the shoulder portion and neck portion, is producible in a relatively very simple way and is connectible to the separate bottom piece, in a simple way. Furthermore, this ensures that a clean separation of the projectile is attained from the sleeve orifice of the synthetic resin sleeve, even under very disadvantageous circumstances, whereby a good target accuracy of the plastic projectile is achieved. Furthermore, tearing off of parts of the case neck or of a propellant charge powder chamber of the synthetic resin sleeve during firing is avoided, which could, for example, contaminate the firearm, block the firearm in its function, or damage the firearm. This applies equally to a training cartridge wherein a dummy projectile bursting at the tip and remaining joined to the synthetic resin sleeve during firing is provided in place of the projectile which is torn off and fired through the barrel of the firearm.

The cartridge case is designed as a thin-walled metallic tube of, for example, steel, brass, or aluminum, exhibiting the external shape of a cartridge or correct caliber, without a projectile, but lacking a cartridge bottom or closure member. Such cases can be preferably produced by deep-drawing of metal strips in suitable multistage operation dies.

The synthetic resin sleeve exhibits at the front end a plastic projectile and/or a corresponding dummy projectile, of correct caliber, and is designed to have an external contour in a tubular zone accommodating the propellant charge powder in such a way that the sleeve can be introduced into the metallic cartridge case from the rear end of the case and so that the sleeve is in firm contact throughout with the inner wall of the case, including the shoulder and the neck portions of the case.

After filling the propellant charge powder into the cartridge case or into the synthetic resin sleeve, the separate bottom piece of metal is inserted in the rearward, open end of the cartridge case and connected to the case by crimping, cementing, or in some other known way for effecting proper sealing and closure of the metallic cartridge case.

In order to fix the synthetic resin sleeve additionally in place within the cartridge case, and to further improve the sealing action with respect to the powder gases in the zone of a rear end of the synthetic resin sleeve, the sleeve is held in position by the front preformed portion of the case and the closure member. For this purpose, for example, the bottom piece or closure member can abut with its front edge against the rear edge of the synthetic resin sleeve, or can also extend thereover in an obturating fashion on the inside.

The invention is illustrated in the drawing with reference to the embodiment having a solid projectile wherein the sole FIGURE is a longitudinal sectional view, and will be explained in greater detail with reference thereto.

The synthetic resin sleeve 5 with the integrally molded-on synthetic resin (plastic) projectile 6 is inserted through the open rear end 4 of the metallic cartridge case 1 having the conical case shoulder 2 and the case neck 3. After the propellant charge powder 7 has been introduced into the lower portion of the sleeve 5, the separate metallic bottom piece 8 with the primer means 9 is inserted in the rear end 4 of the cartridge case 1 and is sealingly and firmly joined therewith by means of the groove 10 produced by crimping. The bottom piece 8 in this arrangement is in contact with its front end 11 with the rear end 12 of the synthetic resin sleeve 5. The metallic cartridge case and closure member are made, e.g., of brass.

The synthetic resin sleeve 5 with plastic projectile or bullet 6 is made, for example, of polyethylene or polypropylene. This sleeve and the cartridge case 1 are adapted to each other preferably in such a way that the neck 3 of the case extends with its forward rim, the case mouth 13, to the rear end 14 of the projectile 6 and terminates at least substantially flush therewith. This ensures an especially smooth tearing off of the projectile.

The advantages attained by the present invention reside in that a plastic projectile, in conjunction with a plastic sleeve, satisfying the requirements of external ballistics, can be connected to the metallic cartridge case in a comparatively simple way from a manufacturing viewpoint, and yet in a reliable way, and in that clean separation of the projectile takes place at the mouth of the case, achieving high target accuracy thereby. Furthermore, as also in case of a training cartridge with dummy projectile, no plastic pieces are torn off during firing from the neck/shoulder portion or from the propellant charge powder chamber, which could, for example, impair functioning of the firearm.

Usually a somewhat smaller hollow space is left above the propellant charge material than shown in the FIGURE. Upon turning of the ammunition in axial direction, the propellant charge material distributes accordingly in the propellant powder chamber. It is common practice for small caliber training ammunition not to fix the propellant charge material. By suitable selection of the primer device and the propellant charge material the inner ballistic characteristics of the ammunition remain independent from the position of the propellant charge material in the cartridge.

An especially preferred variant of the invention is a training cartridge having a plastic bullet where the neck of the jacket shell with its front edge is at least essentially flush with the rear face of the bullet.

The term "flush" means that the front edge of the neck and the rear face are located at one level. During the shooting, the bullet 6 with its ring-shaped tear-off area located at the rear face 14 is slightly radially pressed out by means of the gas pressure over the edge 13 of the neck 3 of the shell having a sharp border, and at the same time, the area of the plastic part that connects directly to the face 14 of the bullet 5 is, by means of the gas pressure, pressed radially to the outside and is sheared off by the border of the neck of the shell that acts as a shearing border. This ensures a clean and fringeless separation of the body of the plastic bullet from the tear of the plastic shell.

We claim:

1. A training cartridge equipped with a synthetic resin projectile comprising a cylindrical metal cartridge case which is open at both ends, a synthetic resin projectile integrally molded onto a synthetic resin sleeve and a separate metal closure member; said synthetic resin sleeve being open at its rear end and being inserted into the cartridge case through one end thereof; said cartridge case having a preformed case shoulder and case neck at the other end; said synthetic resin sleeve being in close contact with said case shoulder, said case neck and an inner wall of the cartridge case and being held therein by means of the separate metal closure member inserted in the other end of the cartridge case and firmly joined to the cartridge case; said synthetic resin sleeve being integrally molded the projectile at a rear end of the projectile; the cartridge case being extended up to the rear end of said projectile; and the case neck, which is at an open end of the cartridge case, being flush with the rear end of the projectile whereby clean separation of the projectile from the sleeve is achieved upon firing of the training cartridge.

2. A training cartridge according to claim 1, wherein the synthetic resin sleeve is held in position by being supported toward the front on the case shoulder and at the rear by the separate metal closure member, said closure member being in contact at its front end with a rear end of the synthetic resin sleeve.

3. A training cartridge according to claim 2, wherein the separate metal closure member is joined to the cartridge case by a groove arrangement produced by crimping a groove into a portion of the case surrounding an inwardly extending flange of said separate metal closure member.

4. The training cartridge according to claim 1, wherein the case is made of a metal selected from the group consisting of brass, steel and aluminum.

5. The training cartridge according to claim 1, wherein the synthetic resin sleeve is formed of polypropylene or polyethylene.

6. The training cartridge according to claim 1, wherein said sleeve has a solid projectile formed at the front end followed towards the rear end with a molded-on neck portion, a shoulder portion, and a portion defining a hollow chamber for propellant powder.

7. The training cartridge according to claim 6, wherein said separate metal closure member is provided with a primer means for effecting ignition of propellant powder contained within said hollow chamber of said sleeve.

* * * * *